United States Patent [19]

Adamo

[11] 4,010,869

[45] Mar. 8, 1977

[54] TIME-DELAYED SINGLE CIGARETTE DISPENSER

[75] Inventor: Charles Adamo, Middle Village, N.Y.

[73] Assignee: Lawrence Peska Associates, Inc., New York, N.Y. ; a part interest

[22] Filed: Jan. 14, 1976

[21] Appl. No.: 649,066

[52] U.S. Cl. ..... 221/15; 206/256

[51] Int. Cl.[2] ..... A45C 11/00

[58] Field of Search ..... 221/15, 88; 206/250, 206/236, 249, 253, 255, 254, 256

[56] References Cited

UNITED STATES PATENTS

| | | | |
|---|---|---|---|
| 2,002,494 | 5/1935 | Eisenberg | 206/255 X |
| 2,819,814 | 1/1958 | Hatch | 221/15 X |
| 3,455,101 | 7/1969 | Marchessault | 206/256 X |

*Primary Examiner*—Stanley H. Tollberg
*Attorney, Agent, or Firm*—Allen D. Brufsky

[57] ABSTRACT

A cigarette dispenser which dispenses cigarettes one at a time through a dispensing opening. The dispenser includes a rotatable magazine having a plurality of cigarette-loaded chambers slideably and rotatably received within a housing. The housing includes an opening adapted to be aligned with one of the chambers during a predetermined time interval determined by the period of operation of a spring motor in the housing cover, which rotates the magazine to sequentially align one of the cigarette chambers with the dispensing opening. In this manner, cigarettes are rationed by the dispenser to dissuade smoking frequency.

5 Claims, 2 Drawing Figures

TIME-DELAYED SINGLE CIGARETTE DISPENSER

BACKGROUND OF THE INVENTION

This invention relates to a dispenser, and more particularly, a cigarette dispenser which rations the cigarettes which are dispensed.

Cigarettes are furnished in packages of twenty and are usually carried about in the pocket or may be placed in a convenient container on a table, desk, or the like and in such arrangement are easily obtainable by a person desiring to smoke one. Habitual smokers of cigarettes find it difficult to refrain from obtaining and smoking a cigarette and frequently feel that if some little restraint were placed upon them, they could easily cut down the number of cigarettes which they smoke.

SUMMARY OF THE INVENTION

Accordingly, it is an object of this invention to provide a cigarette dispenser which, although making cigarettes available, makes them available only at certain predetermined time intervals.

A further object of this invention is to provide a dispenser of the character indicated in which only one cigarette at a time becomes accessible.

A still further object of the invention is to provide a time controlled cigarette dispenser which is easily loaded and operated, simple in construction and inexpensive to manufacture.

The cigarette dispenser consists of:

a cylindrical housing having a dispensing opening, a cylindrical cigarette magazine slideably and rotatably positioned within the housing, the magazine including a plurality of cylindrical chambers radially positioned about the periphery of the magazine each adapted to receive a cigarette and to be sequentially aligned with the dispensing opening, a cover element for the housing, the cover element including motor means operable for a predetermined time interval, a rotatable disc connected to the motor means, and means for operatively connecting the disc to the cigarette magazine when the cover element is attached to the housing, whereby operation of the motor means for a predetermined time interval will cause the disc to rotate the cigarette magazine to align one of the cigarette chambers with the dispensing opening in the housing to enable a single cigarette to be dispensed from the housing during the interval of operation of the motor means.

BRIEF DESCRIPTION OF THE DRAWING

Further objects and advantages of the invention will become more apparent from the following description and claims, and from the accompanying drawing, wherein:

DETAILED DESCRIPTION OF THE PREFERRED EMBODIMENT

Figure 1:
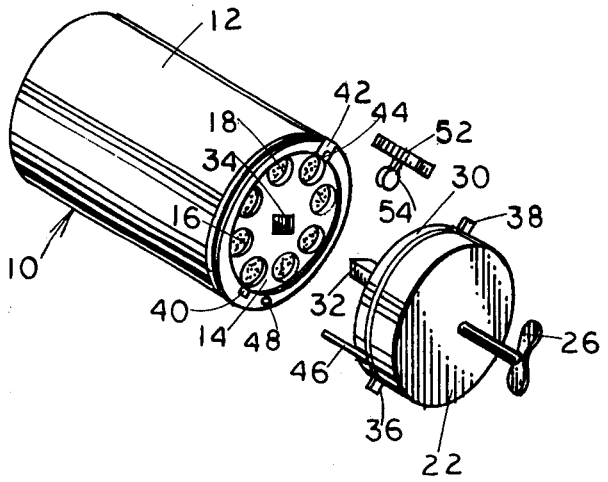
FIG. 1 is an exploded perspective view of the cigarette dispenser of the present invention.

Referring now in detail to the drawing, wherein like numerals indicate like elements throughout the several views, the cigarette dispenser 10 includes a cylindrical housing 12 which slideably and rotatably receives a cylindrical cigarette magazine 14.

Magazine 14 has a plurality of cylindrical chambers 16 spaced radially about the periphery of magazine 14, each chamber 16 slideably receiving a cigarette 18. When each chamber 16 of magazine 14 is filled with a cigarette 18, the magazine 14 is slid into housing 12 until the magazine 14 abuts a wall 20. Wall 20 normally overlies each chamber 16 to prevent a cigarette 18 from being dispensed from any chamber 16.

A cover 22 for cylindrical housing 12 is provided and houses a conventional spring motor 24 that is hand wound by a key 26. An output shaft 28 of spring motor 24 is connected to and drives a rotatable disc 30. A square key 32 on disc 30 is adapted to fit within a square hole 34 in magazine 14 when the cover is connected to the magazine.

Rotating disc 30 also includes a pair of radially extending locking tabs 36, 38 which fit through slots 40, 42, respectively, in the front of housing 12 and are adapted to rotate within an annular groove 44 in the wall of cylindrical housing 12. A pin 46 extends longitudinally from cover 22 and is positioned within hole 48 in housing 12 so as to hold cover 22 in engagement with housing 12.

The rear end of housing 12 includes a single cigarette dispensing opening 50 which is adapted to be aligned with one of the cigarette chambers 16 in magazine 14. In operation, spring motor 24 will rotate disc 30 and its locking tabs 36, 38, as well as magazine 14 to position one of the cigarette chambers 16 in alignment with dispensing opening 50 during the predetermined time interval of operation of spring motor 24. The dispenser 10 may be turned at angle so the cigarette 18 within the aligned chamber 16 will drop through dispensing opening 50.

Figure 2:
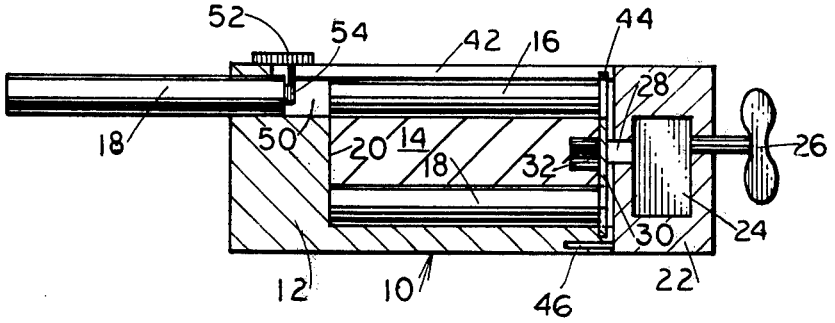
FIG. 2 is a longitudinal cross-sectional view of the dispenser shown in FIG. 1, further illustrating its manner of use.

If desired, a slider 52 having a pusher rod 54 may be used to aid dispensing of cigarette 18 from opening 50. Slot 42 extends for substantially the entire length of housing 12 and each chamber 16 is provided with a complemental slot at its top dead center. Therefore, in order to aid removal of cigarette 18, cover 22 and disc 30 is removed, and slider 52 is positioned above slot 42 with its pusher rod 54 extending downwardly through slot 42 and the complemental slot in chamber 16 and slid forwardly. Pusher rod 54 will contact the end of cigarette 18, as shown in FIG. 2 to push it through opening 50.

To begin a new timed dispensing cycle, it is only necessary to rewind motor 24 using key 26 and replace cover 22 on cylindrical housing. 12.

I claim:

1. A cigarette dispenser comprising:

a cylindrical housing having a dispensing opening, a cylindrical cigarette magazine slideably and rotatably positioned within said housing, said magazine including a plurality of cylindrical chambers radially positioned about the periphery of said magazine each adapted to receive a cigarette and to be sequentially aligned with said dispensing opening, a cover element for said housing, said cover element including motor means operable for a predetermined time interval, a rotatable disc connected to said motor means, and means for operatively connecting said disc to said cigarette magazine when said cover element is attached to said housing, whereby operation of said motor means for a predetermined time interval will cause said disc to rotate said cigarette magazine to align one of said cigarette chambers with the dispensing opening in said housing to enable a single cigarette to be dispensed from said housing during the interval of operation of said motor means.

2. A cigarette dispenser in accordance with claim 1 wherein:

said disc includes a pair of radially extending locking tabs, and an annular groove in said housing rotatably receives said tabs.

3. A cigarette dispenser in accordance with said claim 1 wherein said motor means is a spring motor, and said cover element includes a key to wind said motor.

4. A cigarette dispenser in accordance with claim 1 wherein:

each of said cigarette chambers includes an elongated slot at its top dead center, a complemental slot in said housing is contiguous with said dispensing opening, and a slider having a pusher rod is positioned within said slots to aid in dispensing a cigarette from said chamber aligned with said dispensing opening.

5. A cigarette dispenser in accordance with claim 1 wherein:

said cover element includes a pin, and an opening in said housing is positioned for receiving said pin to connect said cover element and housing.

* * * * *